US005868798A

United States Patent [19]

Anderson et al.

[11] Patent Number: 5,868,798

[45] Date of Patent: Feb. 9, 1999

[54] TREATMENT OF HIDES

[75] Inventors: Colin Charles Anderson, Glenside; Yuri Ronald Obst; Brian Waters, both of Adelaide, all of Australia

[73] Assignee: Tanning Technologies Pty Ltd, Adelaide, Australia

[21] Appl. No.: 793,919

[22] PCT Filed: Aug. 23, 1995

[86] PCT No.: PCT/AU95/00524

§ 371 Date: Feb. 24, 1997

§ 102(e) Date: Feb. 24, 1997

[87] PCT Pub. No.: WO96/06192

PCT Pub. Date: Feb. 29, 1996

[30] Foreign Application Priority Data

Aug. 23, 1994 [AU] Australia ..... PM7610

[51] Int. Cl.[6] ..... C14B 1/26; C14C 15/00

[52] U.S. Cl. ..... 8/94.15; 8/94.16; 8/94.17; 8/94.18; 8/94.19 R; 8/94.2; 8/94.27; 8/148; 8/150; 8/150.5; 69/19; 69/19.1; 69/19.2; 69/19.3

[58] Field of Search ..... 8/94.16, 94.15, 8/94.17, 94.18, 94.19 R, 94.2, 94.27, 148, 150, 150.5; 69/19, 19.1, 19.2, 19.3

[56] References Cited

U.S. PATENT DOCUMENTS

| | | | |
|---|---|---|---|
| 4,202,190 | 5/1980 | Viljanmaa | 96/19.3 |
| 4,333,731 | 6/1982 | Schindlmayr et al. | 8/94.15 |
| 4,438,570 | 3/1984 | Dokoupil | 69/19.3 |
| 4,487,041 | 12/1984 | duBourg | 69/19.1 |
| 5,291,759 | 3/1994 | Dokoupil | 69/19.1 |

FOREIGN PATENT DOCUMENTS

| | | |
|---|---|---|
| 37734/89 | 1/1990 | Australia . |
| 62708/90 | 10/1992 | Australia . |

*Primary Examiner*—Alan Diamond

*Attorney, Agent, or Firm*—Flanagan & Flanagan; John R. Flanagan; John K. Flanagan

[57] ABSTRACT

A process and apparatus for treating animal skins or hides (10) comprises stretching the hide to extend it and to open the structures and mounting the hide in a frame (15) by ties (12) extending between the hide edge attachments (11) and the frame. The hide (10) while in the frame. The hide (10) while in the frame passes through multiple process operations involving sequentially applying treatment fluids under pressure. A pressure differential maintained across the hide thickness enables the fluids to pass through the flesh surface **(10*a*) and emerge from the grain surface (10*b*). The hide (10) can be supported on a porous backing membrane (45)** during treatment. The treatment fluids are collected and processed for recycling, recovery of by-products and disposal.

19 Claims, 4 Drawing Sheets

TREATMENT OF HIDES

This application is a 371 of PCT/AU95/00524 filed Aug. 23, 1995.

This invention relates to the treatment of skins and hides including green and dehydrated skins and hides which, for convenience, will be called "hides" throughout this specification.

The presently used process for treating animal hides so as to produce leather involves batch operations in which hides are immersed successively in different liquids for long periods. This is a time consuming process and large volumes of contaminated spent liquids result, with disposal presenting a substantial problem.

In the presently used process of tanning a hide there are a number of operations which may be carried out from dehairing to tanning and dyeing as identified in the right hand side of FIG. 1. One of the main function is to remove unwanted substances such as soluble proteins since these can degrade over time and reduce the quality or value of the leather. It has been considered essential that mechanical action in the presence of the particular fluid was necessary to help work these proteins out of the hide structure once denatured by the chemicals. To provide this mechanical action, it is considered to be necessary that the material needs to be subject to soaking and agitation in the conventional manner using rotary drums or paddles.

It is an object of the present invention to provide a process and apparatus for the treatment of hides which can enable effective and efficient processing operations involving exposure of the hide to treatment fluids.

It is a preferred object to provide a process and apparatus in which sequential hide treatment operations can be carried out on a continuous basis.

It is a further preferred object to provide a hide treatment process and apparatus enabling elimination of at least some batch processing stages involving soaking and agitation of hides and additionally the resulting generation of large volumes of liquid requiring subsequent treatment and disposal.

According to a first aspect of the invention there is provided a process for treating an animal hide comprising the following sequential steps:

stretching the hide so as to open the structure of the hide sufficient to enhance penetration of treatment fluids into the structure of the hide;

mounting the hide while in the stretched condition in a mounting frame so that the hide is held in the frame for further processing, the step of mounting the hide in the frame comprising mounting edge attachments at points around the perimeter of the hide and coupling the edge attachments by ties to the mounting frame;

applying under pressure a first treatment fluid to the hide in the frame so as to treat the hide with that fluid, the first treatment fluid being selected from depilitant, liming, deliming, bating, pickling and tanning fluids;

collecting the first treatment fluid during application thereof to the hide and treating it for reuse or disposal;

applying under pressure a second different treatment fluid to the hide in the frame so as to treat the hide with that second treatment fluid without the hide having been removed from the frame after application of the first treatment fluid, the second treatment fluid being selected from liming, deliming, bating, pickling, tanning and dyeing fluids;

collecting the second treatment fluid during the application thereof to the hide and treating it for reuse or disposal; and removing the hide from the frame only after treatment thereof by the first, second and any subsequent treatment fluids so as to release the tension applied to the hide.

In this first aspect of the invention, by retaining the hide stretched in a frame to an extent sufficient to open the hide structure, several different treatment fluids can be sequentially applied so that substantially continuous processing of each hide is possible.

In one preferred embodiment, the hide is treated by multiple treatment fluids applied sequentially to the hide while stretched and mounted in the mounting frame prior to and including treatment by a tanning fluid whereby the increase in surface area of the hide effected by stretching the hide to open the hide structure becomes fixed yielding a tanned hide of greater surface area than the hide prior to stretching and mounting in the mounting frame.

According to a second aspect of the invention there is provided a process for treating an animal hide comprising the following sequential steps:

stretching the hide by applying tension to the hide;

mounting the hide so that the hide is held in the stretched condition at a treatment station; and applying a treatment fluid to one surface of the hide at the treatment station at a pressure differential across the thickness of the hide so that the treatment fluid penetrates into and, under the action of the pressure differential, moves through the hide so as to emerge from the other surface thereof.

The present invention also provides an apparatus for carrying out the process of treating an animal hide according to the first or second aspect of the invention, the apparatus comprising stretching means for carrying out the step of stretching the hide, mounting means for carrying out the step of mounting the hide in the stretched condition, and treating means for carrying out the step of applying treatment fluid under pressure to the hide, the stretching means comprising:

a hub located out of the general plane of the stretched hide and located on a line orthogonal to and through the general center of the hide, and a plurality of spokes extending generally radially out from the hub and intersecting the general plane of the hide beyond the perimeter of the hide, each spoke having an inner end pivotally connected to the hub and each being connected from an outer point to the perimeter of the hide by a respective tie within the general plane of the hide, the hub being selectively axially movable towards the hide whereby the angles subtended by the spokes to the plane of the hide reduce and the ties from the outer points to the hide edges cause the hide to be stretched outwardly in the plane of the hide.

Possible and preferred features of the present invention will now be described with particular reference to the accompanying drawings. However it is to be understood that the features illustrated in and described with reference to the drawings are not to be construed as limiting on the scope of the invention. In the drawings:

DETAILED DESCRIPTION OF THE INVENTION

The process of the present invention is based on the finding that by application of treatment fluids to an animal hide while the hide is in the process of being stretched or is being held in tension in a stretched condition, treatment fluids penetrate into the hide enabling unwanted substances, such as fats and soluble proteins, to be released and removed from the hide without the need for mechanical agitation of the hide. The tension applied to the hide may be sufficient to open the structure of the hide and this facilitates or enhances the penetration of the chemical treatment fluids, e.g. to remove the soluble proteins.

Figure 1:
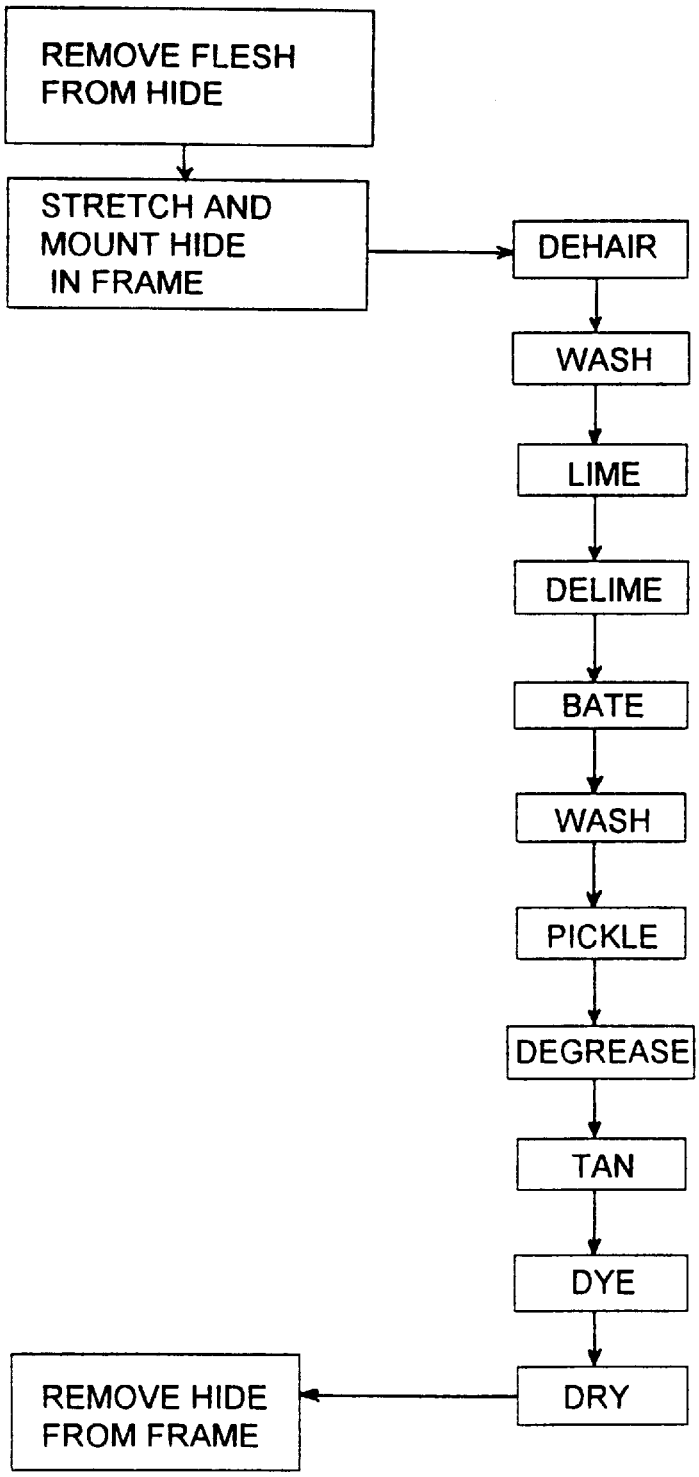
FIG. 1 is a flow chart for a hide treatment process embodying the present invention, FIG. 2 schematically illustrates a hide treatment process and apparatus, FIG. 3 schematically illustrates a hide stretching apparatus useable in the present invention.

In the diagram of FIG. 1, the wet processes in the vertical column at the right hand side, namely dehairing, washing, liming, deliming, bating, washing, pickling, degreasing, tanning, and dyeing, and the final drying, are all conventional tannery processes. Some or all of these processes can be carried out according to the process of the present invention by firstly sketching the hide so as to open the structure sufficient to enhance penetration of treatment fluids into the structure and then mounting the hide while in the stretched condition preferably in a mounting frame, so that the hide is held in the stretched condition for the further processing operations. As shown in FIG. 1, the hide may have any remaining flesh removed prior to stretching and mounting of the hide in the frame.

As further described later in connection with FIGS. 3 to 5, the step of mounting the hide 10 comprises mounting edge attachments 11 such as toggles or clamps at points around the perimeter of the hide and coupling the edge attachments 11 by ties 12 to the mounting frame 15. The ties 12 can include resilient ties, e.g. incorporating tension springs 13, which apply tension through the edge attachments 11 to the hide 10 by being resiliently stretched beyond their relaxed lengths when connected to the edge attachments 11.

Figure 2:
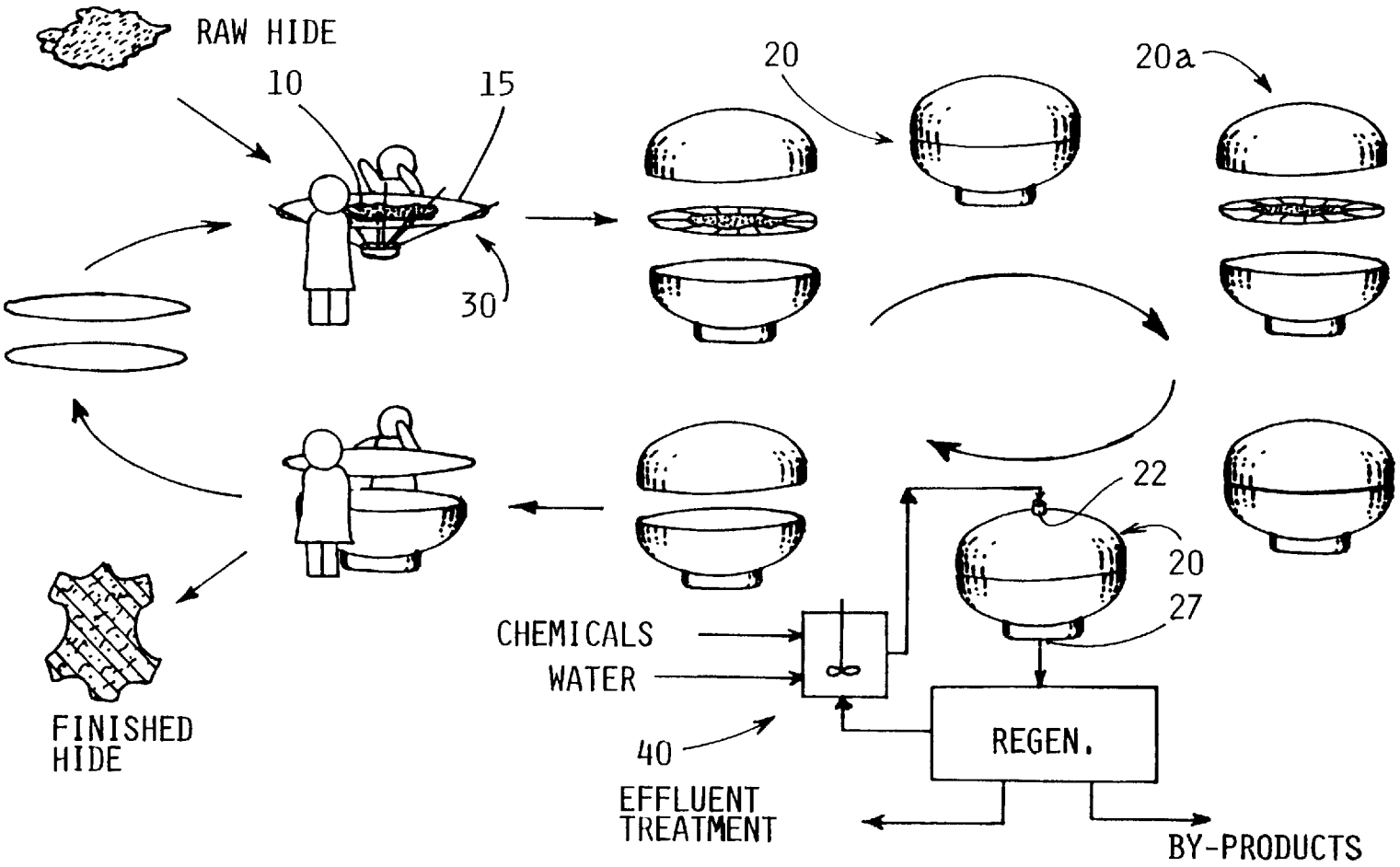

After mounting the hide 10 the mounting frame 15, a first treatment fluid is applied under pressure to the hide in the frame so as to treat the hide with that fluid, the first treatment fluid being selected from dehairing, liming, deliming, bating, pickling and tanning fluids. The treatment fluid is collected during application thereof to the hide and treated for reuse, recovery of by-products or disposal (after suitable treatment). The collection and regeneration is shown in FIG. 2 for only one treatment station, but suitable collection and regeneration systems can be provided for all treatment fluids. The process of continuous treatment then comprises the step of applying under pressure a second different treatment fluid to the hide in the frame so as to treat the hide with that second treatment fluid without the hide having been removed from the frame after application of the first treatment fluid, the second treatment fluid being selected from one of the later stage treatment fluids, namely liming, deliming, bating, pickling, tanning and dyeing fluids. As with the first treatment fluid, the second treatment fluid is collected during the application thereof to the hide and it is processed for reuse or disposal. The hide is removed from the frame only after complete treatment by the first and second and any subsequent treatment fluids and final drying so as to release the tension applied to the hide.

The application of treatment fluids to the hide 10 while held stretched in the frame 15 may comprise spraying the fluids under pressure against one or both surfaces of the hide. The hide for example could be passed through successive fluid application stations such as spray booths. The frames may be stacked for allowing chemical reaction times between successive spraying operations. High pressure jets, or high or low pressure sprays, can be applied to the flesh side or to the outside or "grain" side as may be determined for optimum results for the particular operation. The hides during these operations may be vertical to facilitate drainage of the fluids and collection of the fluids for recycling. For dehairing or dewooling, the treatment fluid would be a depilitant liquid and this may be applied to the outside or grain surface of the hide to facilitate removal of hair or wool. However, in most cases and particularly in the case of a woolly sheep's hide where the wool may impede penetration of the liquid to the surface, the depilitant liquid may be applied under pressure to the flesh side of the hide so that the liquid penetrates into the hide to loosen the wool enabling subsequent removal.

As an alternative to directing the treatment fluid under pressure against a surface of the hide, the application of treatment fluids may comprise applying the treatment fluid to one surface of the hide in such a way that the treatment fluid penetrates into and moves through the hide under the action of a pressure differential so as to emerge from the other surface thereof. This alternative process for applying treatment fluids is also carried out on a hide stretched and mounted so as to be held in the stretched condition at the treatment station. The step of stretching the hide also preferably comprises applying tension of a sufficient magnitude so as to open the structure of the hide to an extent sufficient to facilitate penetration of the treatment fluid into, and passage of the treatment fluid through, the thickness of the hide.

To achieve the passage of the treatment fluid through the hide, the creation of a fluid pressure differential between one surface of the hide and the opposite surface and across substantially the entire surface area to be treated is preferred. This can be achieved by applying treatment fluid under positive pressure to one surface and/or by applying section to the opposite surface.

Figure 6:
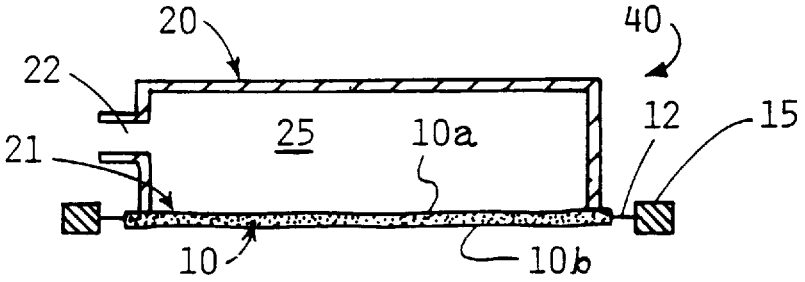

In an experimental rig as illustrated in FIG. 6, a hide 10 has been stretched across a vessel 20 having an open or a permeable bottom surface 21 so that a seal is formed around the edges of the open or permeable bottom. Treatment liquid was then fed into the vessel through an inlet port 22 in the side or top of the vessel 20, the fluid being pressurised at low pressure, e.g. at a pressure of 20 psi or less, so that the liquid penetrated into the hide 10 and was forced through the hide to emerge from the outer surface 10*b*. The collected liquid forced through the stretched hide 10 revealed the presence of the fats or proteins which the particular liquid was intended to extract, thereby demonstrating the feasibility of carrying out process operations by the present invention which are presently carried out by immersion of hides in batch processing drums. Further tests have demonstrated penetration and passage of liquids at pressure differentials of less than 10 psi, less than 5 psi, e.g. 2 to 3 psi. Even less than 1 psi may prove useful. Pressures as high as 50 psi or even 70 psi (ca.500 kPa) may be useful. The pressure needed for effective penetration can depend on the particular stage, the chemical being used, and on the kind and state of the skin, and its degree of extension by stretching. Empirical methods can be used to determine effective pressures.

The process sequence illustrated schematically in FIG. 2 illustrates a treatment operation utilising pressurised application of treatment fluids to one side of a hide in a treatment vessel 20 so that the treatment fluid penetrates into and passes through the thickness of the hide to be collected for regeneration, particularly for recycling of treatment fluid, recovery of valuable by-products, and effluent treatment and disposal. One particular apparatus for implementing this treatment process is described later in connection with FIG. 7.

As described earlier, edge attachments 11 are mounted at points around the perimeter of the hide 10 and the edge attachments are coupled by ties to the mounting frame 15. The frame provides the anchor for the tensioning forces applied to the hide at its perimeter. The hide is thereby held in permanent extension at a desired tension level with its surfaces exposed enabling its transportation in the tensioned state between treatment stations in the tanning process in FIG. 2. With the greatly accelerated treatment times due to tensioning and pressure application or injection of chemicals at each of these stations, a continuous automated or semi-automated tanning process can be achieved.

The present invention provides an apparatus for carrying out the process of treating an animal hide, the apparatus comprising stretching means 30 for stretching the hide 10, mounting means 15 for mounting the hide in the stretched condition, and treating means 40 for applying under pressure treatment fluid to the hide.

The required tensioning forces can be initially applied to the hide 10 to stretch it for example by employing a system (not illustrated) of pressure controlled pneumatic air cylinders applying radially outwardly directed tension through toggle attachments to the hide at its peripheral edges.

Figure 3:
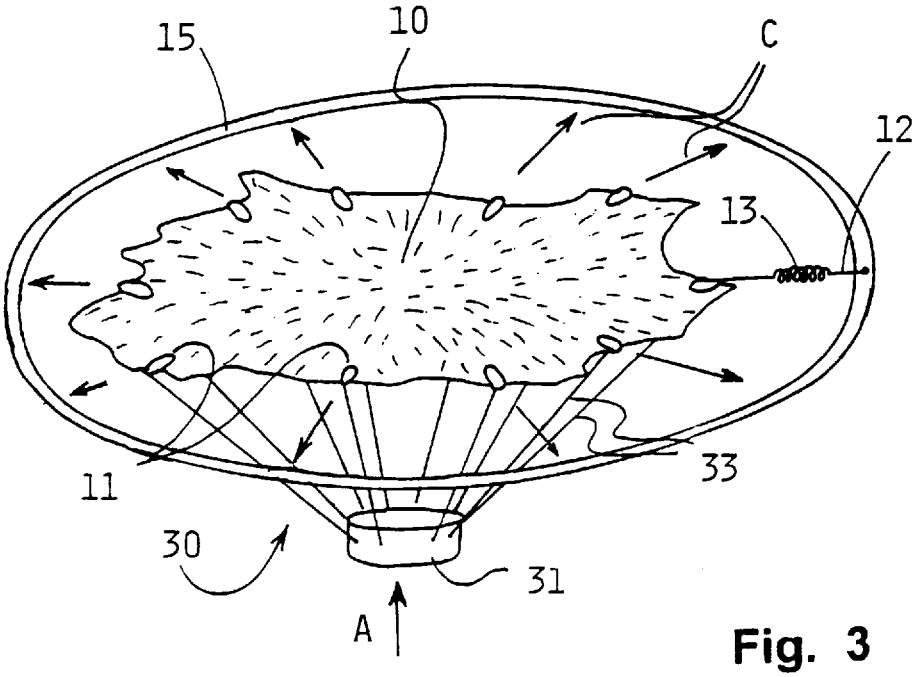
Figure 4:
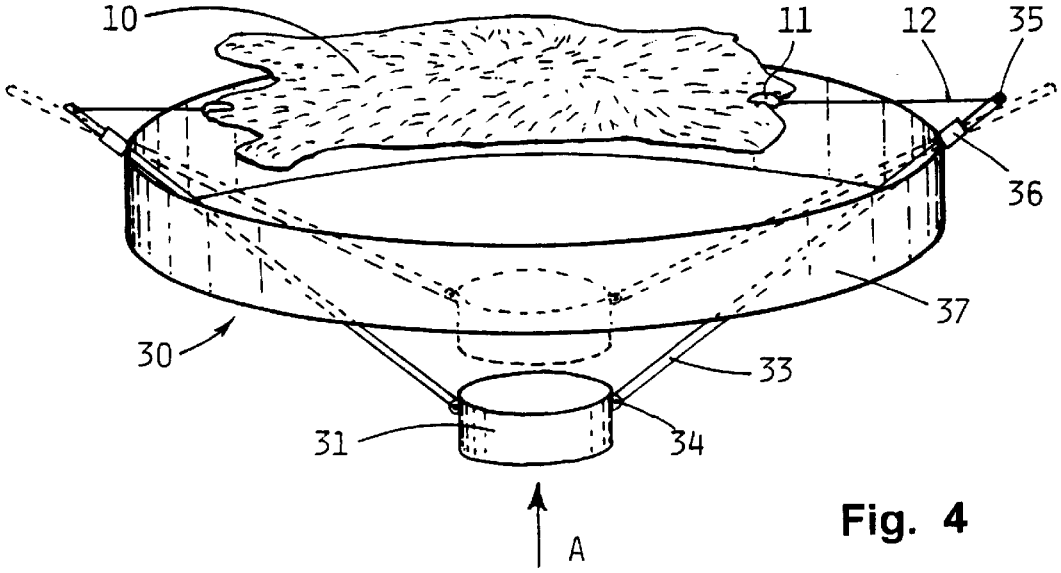
FIG. 4 is a perspective view of a hide stretching apparatus.
Figure 5:
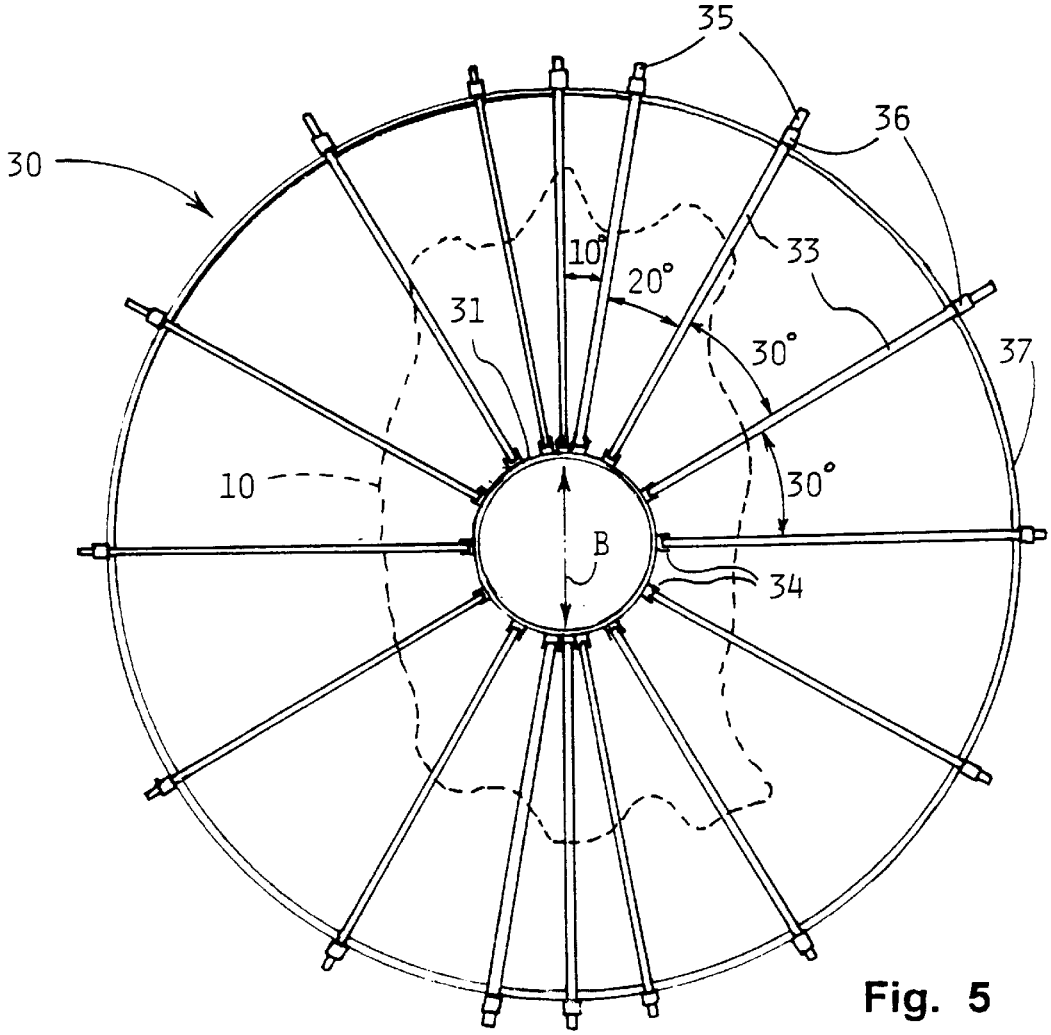
FIG. 5 is a plan view of the apparatus of FIG. 4, and FIGS. 6 and 7 are side sectional views through apparatus for use in the present invention.

In FIGS. 3 to 5, a possible stretching means 30 comprises a hub 31 located out of the general plane of the stretched hide 10 and located on a line orthogonal to and through the general center of the hide 10.

A plurality of spokes 33 extend generally radially out from the hub 31 and intersect the general plane of the hide 10 beyond the perimeter of the hide. Each spoke has an inner end 34 pivotally connected to the hub 31 and has an outer point 35 connected to the perimeter of the hide 10 by a respective tie 12 within the general plane of the hide 10. The spokes 33 slidably pass through collars or rings 36 mounted around the fixed hoop 37 so that the desired angular spacing of the spokes is maintained. The hub 31 is selectively axially movable towards the hide 10 as shown by arrow A in FIGS. 3 and 4 whereby as shown in broken line in FIG. 4, the angles subtended by the spokes 33 to the plane of the hide 10 reduce and the outer points 35 move outwardly so that the ties to the hide edges cause the hide to be stretched outwardly in the plane of the hide 10. This stretches the hide in its plane in all directions as shown by arrows C in FIG. 3. In FIG. 4, only two spokes 33 are illustrated for simplicity, but as shown in FIGS. 3 and 5, in practice spokes are spaced around the entire perimeter of the hide.

Hides generally have a longitudinal axis B corresponding to the general line of the spine of the animal from which the hide came. As shown in FIG. 5 the spokes 33 in plan view can be unequally angularly spaced around the hub 31, there being a greater angular spacing, e.g. 30°, between respective adjacent spokes extending in directions generally transverse to the longitudinal axis B so that there is a greater number of spokes 33 (e.g. with 10° or 20° between adjacent spokes) applying stretching forces to the hide along and close to the longitudinal axis B. Since the hide can be thicker along the spine, to achieve uniform stretching along the region of the longitudinal axis B closer spacing of attachment points 11 is desirable. In FIG. 5 there are sixteen spokes, although more or less may be useable, e.g. for different hides.

Referring to FIG. 6, the hide 10 while held stretched in the frame 15 can be, located adjacent to a vessel 20 with a fluid supply chamber 25 having an open side 21 so that the hide has one surface 10*a* thereof located over the opening so as to at least partially close the opening 21. The treatment fluid is supplied under pressure to the supply chamber 25 so that the treatment fluid flows out of the chamber 25 at the opening 21 and encounters the surface 10*a* of the hide. The treatment fluid penetrates into the hide through the surface 10*a*, passes through the thickness of the hide and emerges from the other surface 10*b*.

Figure 7:
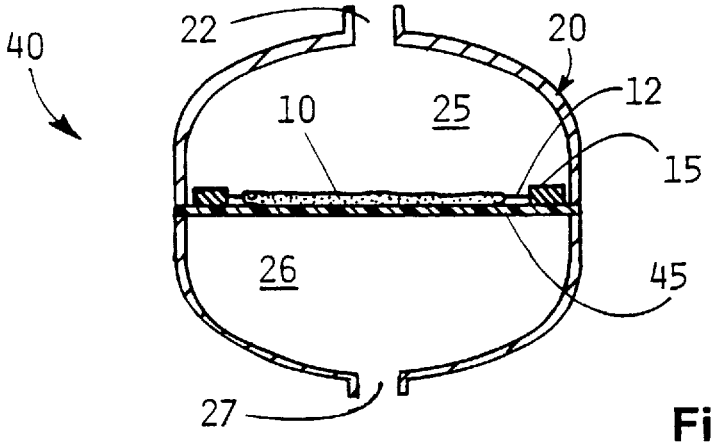

In FIG. 7, the step of mounting the hide 10 comprises locating the hide on a permeable backing 45 so as to support the hide 10 during the application of the treatment fluid under pressure whereby the treatment fluid penetrates into and passes through the hide and passes also through the permeable backing 45.

The permeable backing 45 may comprise a permeable membrane, such as a porous polypropylene membrane. The material of the membrane must be inert (non-reactive) with the chemical treatment fluid(s) being used while that membrane is in use. Different materials may be needed for different treatment liquids.

The permeable backing 45 preferably has a permeability about equal to or less than the permeability of the hide 10 so that a substantial amount of the treatment fluid under pressure passes through the hide without predominantly flowing preferentially around the hide and through the permeable backing beyond the perimeter of the hide. For the function of the membrane, it is important that it allows a pressure differential to be maintained across the hide thickness while the hide is preferably stretched and supported on the membrane, and additionally the membrane complements the hide material regardless of size, shape and damage, thereby allowing uniform penetration and processing using the treatment fluids.

In FIG. 7 the vessel 20 is a closed vessel with the permeable backing 45 having the hide 10 thereon being located within the vessel so as to divide the vessel into an upstream chamber 25 to one side of the permeable backing and a downstream chamber 26 on the other side of the permeable backing. The treatment fluid is supplied through inlet 22 to the upstream chamber 25 under pressure whereby the treatment fluid passes through the hide 10 and through the membrane 45 into the downstream chamber 26 from where the treatment fluid is withdrawn through outlet 27. The grain side of the hide 10 is normally applied to the permeable backing 45. As illustrated schematically in FIG. 2, the treatment fluid collected from the downstream chamber can be regenerated for recycling, recovery of valuable by-products and effluent treatment and disposal.

The permeable backing membrane 45 is expected to require maintenance but selection of the membrane can help minimise maintenance. For example, flushing of the membrane such as by pressurised reverse flow of fluid through the membrane may be necessary or desirable to remove any trapped material that has been removed from the treated hides and has lodged in the interstices in the membrane. A single membrane may be used for multiple treatment fluid applications on each hide. Alternatively, or in addition, the membrane may be replaced or substituted by a membrane having different chemical or physical properties suitable for subsequent treatment fluids being applied during the processing of a single hide. Thus, as illustrated in FIG. 2, the vessel 20 in which the hide 10 is located during the processing may need to be opened at one or more stages as shown at 20*a* for replacement of the membrane. Also if desired, the frame 15 carrying the stretched hide 10 may be removed e.g. for temporary storage of the frame if some reaction time for a particular treatment fluid is necessary before subsequent process stages are carried out. In this case, the vessel may be opened and the frame removed, and another frame having a hide which has stood for the desired reaction time may be loaded into the opened vessel at the same station enabling efficient usage of the apparatus to be achieved.

It will be seen that by utilising the inventive processes, a substantially continuous processing operation can replace the present batching processes for hide tanning. This design may enable a large degree of automation of movement of the frames through the process stages.

With the hide being held stretched on the same frame at each stage of the tanning process, the production times for tanning may be reduced from between twenty four and forty eight hours with conventional methods, to one to two hours with the present invention. Individual treatment operations which presently involve hours in process drums may now take times measured in minutes. With the surfaces of the hide fully exposed, removal of wool or hair, and the extraction of unwanted soluble proteins (pickling) is facilitated. It is expected that this invention may reduce a present processing time measured in days to a time measured in minutes.

The required use of water can be reduced to a minimum, so that the very difficult environmental problems associated with conventional methods can be alleviated. The present effluent problems associated with tanning requires treatment of large volumes which will not be required in this instance, as the system will allow for recycle and re-use of the chemicals required. The use of membranes will allow micro filtration of the chemicals to be cost effective due to the substantial decrease in contaminant and volume of water required per process stage.

This processing method can greatly improve the working environment in the industry and offer manufacturing efficiencies, greatly in advance of present methods. This can be reflected in a reduction in chemical costs.

It is further envisaged that product quality can benefit due to the ability to continuously monitor operation of this equipment, e.g. by sampling and analysing chemicals, so as to provide optimum process control. Parameters that can be monitored and continuously optimised include particular chemical concentrations and pH, rates of change of such parameters, temperatures, pressures, flow rates and treatment times. Also, with the use of this invention, 'ribbiness' of certain breed sheep hides may be removed by fixing the 'rib' in a tensioned state, chrome tanning and then drying the hide to produce a smooth 'non-ribby' tanned hide.

Furthermore, the extent of extension due to stretching can be fixed by the complete tanning process so that the final treated hide when removed from the frame can have an increased surface area. For example, a 5% linear extension in all directions if fixed as a result of the process produces a 10% increase in area of the hide.

It is to be understood that various alterations, modifications and/or additions may be made to the features of the possible and preferred embodiment(s) of the invention as herein described without departing from the scope of the invention as defined in the claims.

We claim:

1. A process for treating an animal hide comprising the following sequential steps:

stretching the hide so as to open the structure of the hide sufficient to enhance penetration of treatment fluids into the structure of the hide;

mounting the hide while in the stretched condition in a mounting frame so that the hide is held in the frame for further processing, the step of mounting the hide in the frame comprising mounting edge attachments at points around the perimeter of the hide and coupling the edge attachments by ties to the mounting frame;

applying under pressure a first treatment fluid to the hide in the frame so as to treat the hide with the fluid, the first treatment fluid being selected from depilitant, liming, deliming, bating, pickling and tanning fluids;

collecting the first treatment fluid during application thereof to the hide and treating it for reuse and disposal;

applying under pressure a second different treatment fluid to the hide in the frame so as to treat the hide with the second treatment fluid without the hide having been removed from the frame after application of the first treatment fluid, the second treatment fluid being selected from liming, deliming, bating, pickling, tanning and dyeing fluids;

collecting the second treatment fluid during the application thereof to the hide and treating it for reuse or disposal; and removing the hide from the frame only after treatment thereof by the first, second and any subsequent treatment fluids so as to release the tension applied to the hide.

2. A process as claimed in claim 1, wherein the ties include resilient ties which apply tension through the edge attachments to the hide by being resiliently stretched beyond their relaxed lengths when connected to the edge attachments.

3. A process as claimed in claim 1, wherein the hide is treated by multiple treatment fluids applied sequentially to the hide while stretched and mounted in the mounting frame prior to and including treatment by a tanning fluid whereby an increase in surface area of the hide effected by stretching the hide to open the hide structure becomes fixed yielding a tanned hide of greater surface area than the hide prior to stretching and mounting in the mounting frame.

4. A process as claimed in claim 1, wherein each of the steps of applying under pressure the first and second treatment fluids comprises applying under pressure the respective treatment fluid to one surface of the hide so that the respective fluid penetrates into and is forced through the hide under the action of the pressure so as to emerge from the other surface thereof.

5. A process as claimed in claim 1, wherein at least one of the steps of applying the first and second treatment fluids comprises spraying the respective treatment fluid under pressure against a surface of the hide.

6. A process for treating an animal hide comprising the following sequential steps:

stretching the hide by applying tension to the hide;

mounting the hide while in the stretched condition so that the hide is held in the stretched condition at a treatment station; and applying a treatment fluid to one surface of the hide at the treatment station at a pressure differential across the thickness of the hide so that the treatment fluid penetrates into and, under the action of the pressure differential, moves through the hide so as to emerge from the other surface thereof;

wherein the step of mounting the hide comprises locating the hide on a permeable backing membrane so as to support the hide during the application of the treatment fluid under the pressure differential whereby the treatment fluid penetrates into and passes through the hide and passes also through the permeable backing membrane.

7. A process as claimed in claim 6, wherein the permeable backing membrane has a permeability equal to or less than the permeability of the hide so that substantial treatment fluid under the pressure differential passes through the hide without predominantly flowing around the hide and through the permeable backing membrane beyond the perimeter of the hide.

8. A process as claimed in claim 6, wherein the application of the treatment fluid is carried out in a closed vessel with the permeable backing membrane having the hide thereon being located within the vessel so as to divide the vessel into an upstream chamber to one side of the permeable backing membrane and a downstream chamber on the other side of the permeable backing membrane, the treatment fluid being supplied to the upstream chamber under positive pressure whereby the treatment fluid passes through the hide and through the permeable backing membrane into the downstream chamber from where the treatment fluid is withdrawn.

9. A process as claimed in claim 6, wherein a grain side of the hide is applied to the permeable backing membrane.

10. A process as claimed in claim 6, wherein the treatment fluid is applied to the one surface at a positive pressure to achieve the pressure differential.

11. A process as claimed in claim 6, wherein the step of stretching the hide comprises applying tension of sufficient magnitude so as to open the structure of the hide to an extent sufficient to enhance penetration of the treatment fluid into, and passage of the treatment fluid through, the thickness of the hide.

12. A process as claimed in claim 6, wherein the step of mounting the hide comprises mounting edge attachments at points around the perimeter of the hide and coupling the edge attachments by ties to a mounting frame.

13. A process as claimed in claim 12, wherein the ties include resilient ties which apply tension through the edge attachments to the hide by being resiliently stretched beyond their relaxed lengths when connected to the edge attachments.

14. A process as claimed in claim 10, wherein the step of applying treatment fluid to the hide comprises applying the treatment fluid at low pressure.

15. A process as claimed in claim 14, wherein the pressure at which the treatment fluid is applied to the hide is about equal to or less than 20 psi.

16. A process as claimed in claim 15, wherein the pressure at which the treatment fluid is applied to the hide is less than 5 psi.

17. A process as claimed in claim 4, wherein the treatment fluid comprises a depilitant liquid, and the step of applying the depilitant liquid comprises applying the liquid under pressure to a flesh side of the hide so that the liquid penetrates into and passes through the hide to emerge from an outside grain surface to facilitate subsequent removal of hair or wool from the outside grain surface.

18. An apparatus for treating an animal hide, the apparatus comprising stretching means for stretching the hide by applying tension to the hide, mounting means for mounting the hide while in the stretched condition so that the hide is held in the stretched condition at a treatment station, and treating means for applying a treatment fluid to one surface of the hide at the treatment station at a pressure differential across the thickness of the hide so that the treatment fluid penetrates into and, under the action of the pressure differential, moves through the hide so as to emerge from an outer surface thereof, the mounting means comprising a permeable backing to support the hide during the application of the treatment fluid by the treating means under the pressure differential whereby the treatment fluid penetrates into and passes through the hide and passes also through the permeable backing; the stretching means comprising:

a hub located out of a general plane of the stretched hide and located on a line orthogonal to and through, the general center of the hide, and a plurality of spokes extending generally radially out from the hub and intersecting the general plane of the hide beyond the perimeter of the hide, the spokes each having an inner end pivotally connected to the hub and each being connected from an outer point to a perimeter of the hide by a respective tie within the general plane of the hide, the hub being selectively axially movable towards the hide whereby the angles subtended by the spokes to the plane of the hide reduce and the ties from the outer points to the hide edges cause the hide to be stretched outwardly in the plane of the hide.

19. Apparatus as claimed in claim 18, wherein the hide has a longitudinal axis corresponding to a general line of a spine of an animal from which the hide came, the spokes being unequally angularly spaced around the hub, there being a greater angular spacing between respective adjacent spokes extending in directions generally transverse to the longitudinal axis so that there is a greater number of spokes applying stretching forces to the hide in the general direction of the longitudinal axis.

* * * * *